US005337737A

United States Patent [19]

Rubin et al.

[11] Patent Number: 5,337,737

[45] Date of Patent: Aug. 16, 1994

[54] DYNAMIC ORTHOSIS WITH PROPORTIONAL RESISTANCE

[75] Inventors: Stuart A. Rubin, Bronx, N.Y.; Vasantha L. Murthy, Northvale, N.J.

[73] Assignee: Albert Einstein College of Medicine of Yeshiva University, Bronx, N.Y.

[21] Appl. No.: 68,593

[22] Filed: May 27, 1993

Related U.S. Application Data

[63] Continuation of Ser. No. 819,760.

[51] Int. Cl.[5] ..... A61H 1/02

[52] U.S. Cl. ..... 601/33; 128/26; 128/898; 482/111; 602/20

[58] Field of Search ..... 128/25 R, 26, 898; 602/16, 20, 23; 482/111-113

[56] References Cited

U.S. PATENT DOCUMENTS

| | | | |
|---|---|---|---|
| 3,683,897 | 8/1972 | Shield et al. | 128/25 R |
| 3,976,057 | 8/1976 | Barclay | 128/25 R |
| 4,149,532 | 4/1979 | Terry et al. . | |
| 4,237,873 | 12/1980 | Terry et al. . | |
| 4,259,949 | 4/1981 | Axelsson . | |
| 4,595,179 | 6/1986 | Glabiszewski . | |
| 4,784,120 | 11/1988 | Thomas . | |
| 4,899,735 | 2/1990 | Townsend et al. | 128/25 R X |
| 4,996,977 | 3/1991 | Tiedeken . | |
| 5,116,296 | 5/1992 | Watkins et al. | 128/25 R X |
| 5,117,814 | 6/1992 | Luttrell et al. | 128/25 R |

*Primary Examiner*—Richard J. Apley
*Assistant Examiner*—Linda C. M. Dvorak
*Attorney, Agent, or Firm*—Amster, Rothstein & Ebenstein

[57] ABSTRACT

A dynamic orthosis incorporating proportional resistance across a major joint connecting proximal and distal body portions (e.g., the elbow connecting the upper arm and forearm), includes a first orthotic coupler for grasping the proximal body portion for movement therewith and a second orthotic coupler for grasping a distal body portion for movement therewith. A connector connects portions of said pair of couplers and permits said first and second couplers to pivot freely relative to one another about the pivotal axis of the major joint. A resistance is disposed between and operatively connects the couplers for creating a bidirectional velocity proportional resistance in both tension and compression modes to relative pivotal movement of the couplers, whereby rapid dysmetric relative movement of the proximal and distal body portions is dampened more by the resistance than is slow controlled relative movement thereof.

13 Claims, 6 Drawing Sheets

DYNAMIC ORTHOSIS WITH PROPORTIONAL RESISTANCE

This is a continuation of copending application Ser. No. 07/819,760 filed on Jan. 13, 1992, now abandoned.

BACKGROUND OF THE INVENTION

The present invention relates to a dynamic orthosis for people suffering from severe dysmetria and the like, and more particularly to such an orthosis which dampens rapid dysmetric relative movement more than slow controlled relative movement.

Patients suffering from neurological conditions affecting the cerebellum or its connections, such as multiple sclerosis, resulting in severe dysmetria may have such severe intention tremors (especially those involving all motions and joints moving the upper extremities) that the daily tasks of life, such as even the simplest self-feeding, becomes practically impossible. Such non-functional tremors may occur across any major joint connecting proximal and distal body portions, for example, the neck connecting the head and body (i.e., titubation), the elbow connecting the upper arm and forearm (i.e., dysmetria), the knee connecting the thigh and lower leg (i.e., dysmetria), etc. For the purposes of the present invention, all of these will be referred to as dysmetria.

The conventional orthotic devices for use with such patients are primarily constraints on the possible movement of the patient rather than dampeners which permit desired controlled movement while filtering out undesired dysmetria movements. U.S. Pat. No. 4,237,873 discloses a cerebral palsy arm and hand brace which utilizes a spring-loaded piston-piston rod extension-contraction unit to control tremors in a patient's arm. One end of the brace must be fastened to a relatively fixed rigid structure such as the back of a chair, the wheelchair frame, or a back plate strapped to the patient. Additionally, the brace involves several rotatable joints which add to the complexity and cost of the device, introduce additional maintenance problems, and the like.

Accordingly, it is an object of the present invention to provide a dynamic orthosis which incorporates a proportional resistance across a major joint connecting proximal and distal body portions.

Another object is to provide such an orthosis which dampens rapid non-functional dysmetric relative movements of the proximal and distal body portions more than slow controlled relative movements thereof.

It is also an object to provide such an orthosis which comprises a connected pair of orthotic coupling means and a resistance means, with the resistance means being connected to the pair of connected orthotic coupling means only by a pair of pivot joints.

It is another object to provide such an orthosis which is comfortable and convenient to wear.

It is a further object to provide such an orthosis which is simple and economical to manufacture, use and maintain.

SUMMARY OF THE INVENTION

The proximal to and related objects of the present invention are obtained in a dynamic orthosis incorporating proportional resistance across a major joint connecting proximal and distal body portions. The orthosis comprises a pair of orthotic coupling means, including a first coupling means for grasping a proximal body portion for movement therewith and a second coupling means for grasping a distal body portion for movement therewith. Connecting means connect the first and second coupling means and permit the first and second coupling means to pivot freely relative to one another about the pivotal axis of the major joint. A resistance means operatively connects the first and second coupling means for creating a bidirectional velocity proportional resistance in both tension and compression modes to relative pivotal movement of the first and second coupling means, whereby rapid non-functional dysmetric relative movement of the proximal and distal body portions is dampened more by the resistance means than slow controlled relative movement thereof.

In a preferred embodiment, the proximal and distal body portions are first and second limb portions—e.g., the major joint is an elbow and the proximal and distal limb portions are the upper arm and lower arm (forearm), respectively. The resistance means is a bidirectional cylinder-piston shock absorber and is disposed between the first and second coupling means at all angle to the longitudinal axes of the coupling means. The resistance means is operatively connected (preferably pivotally) at one end thereof to the first coupling means and at the opposite end thereof to the second coupling means, the resistance means being operatively connected only to the first and second coupling means. Preferably there are only four pivotable joints intermediate the first and second coupling means.

The connecting means preferably includes a rigid upper leg secured to and extending parallel to the longitudinal axis of the first coupling means, a rigid lower leg secured to and extending parallel to the longitudinal axis of the second coupling means, and a pivot mechanism pivotably connecting the upper and lower legs for pivotal relative movement thereof.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with the accompanying drawing wherein.

DETAILED DESCRIPTION OF THE PREFERRED EMBODIMENTS

Figure 1:
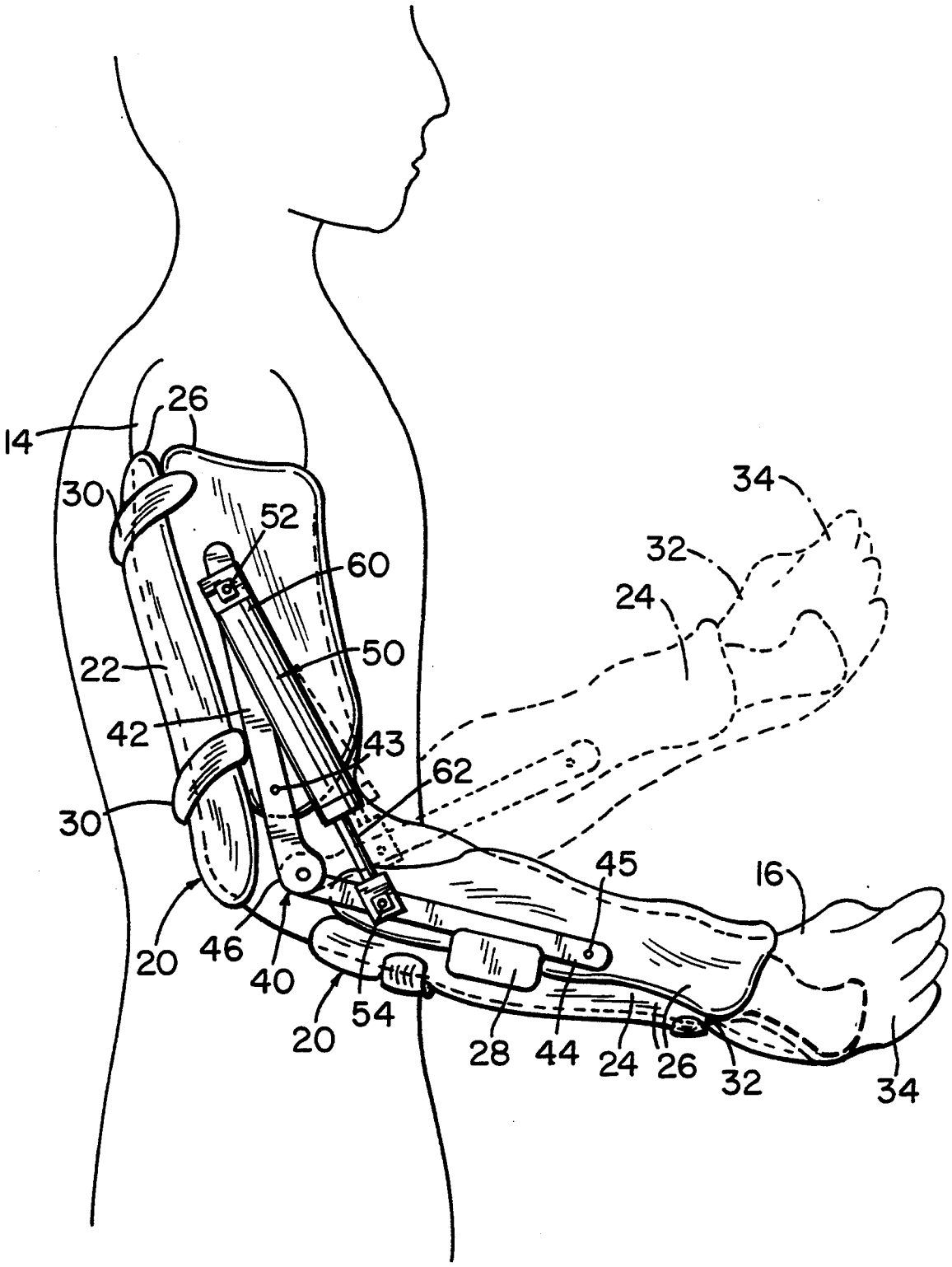
FIG. 1 is a side elevational view of a dynamic orthosis according to the present invention as used on the arm of a wearer, the orthosis in one position of use being illustrated in solid line and in another position of use being illustrated in phantom line.
Figure 2:
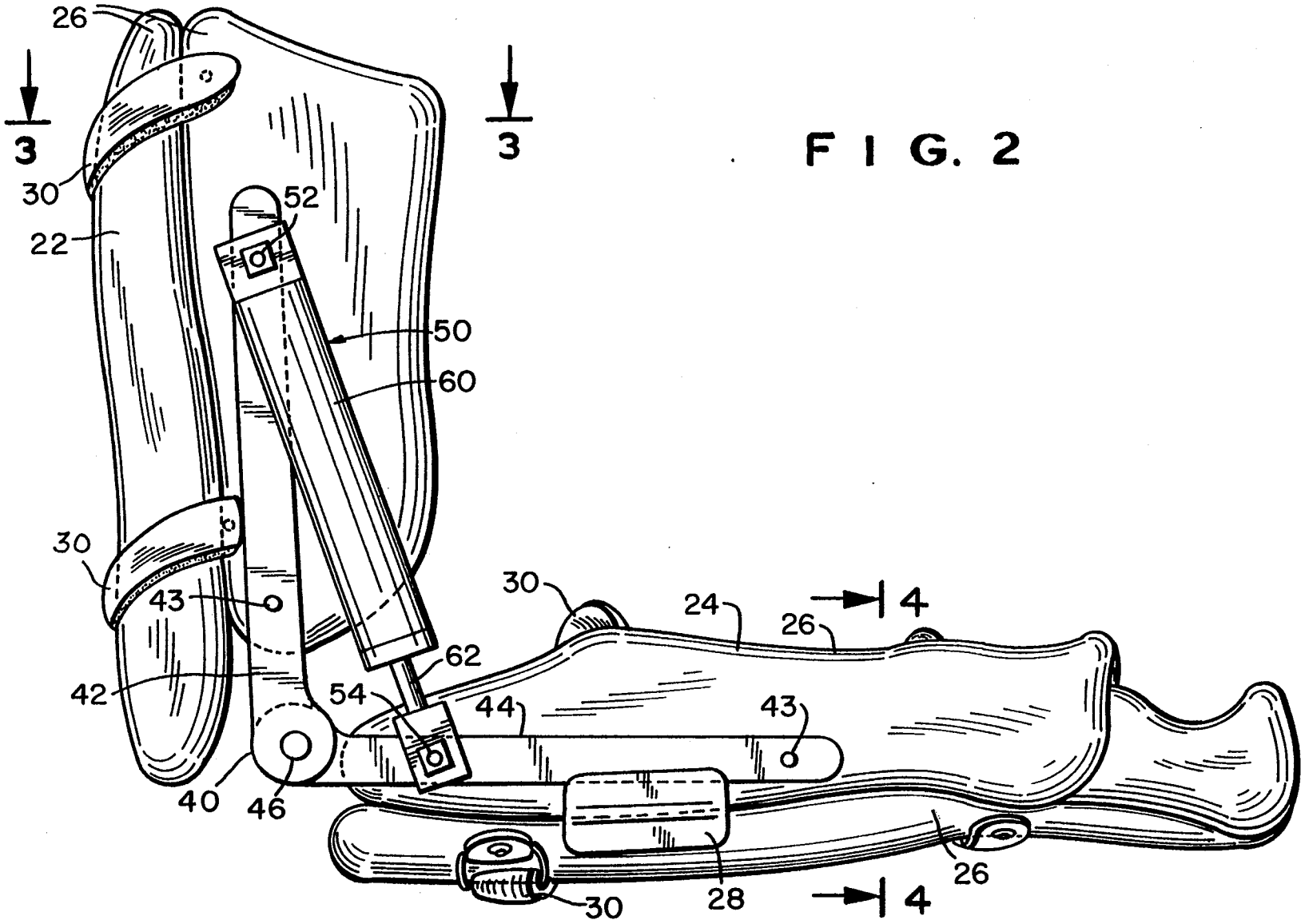
FIG. 2 is a side elevational view thereof in a third position of use.

Referring now to the drawing, and in particular to FIG. 1 thereof, therein illustrated is a dynamic orthosis according to the present invention, generally designated by the reference numeral 10. The orthosis 10 incorporates proportional resistance across a major joint connecting proximal and distal body portions, such as the elbow connecting the upper and lower arms, the knee connecting the upper and lower legs, the neck, the shoulder, the hip, and the like. While the orthosis 10 is illustrated as extending across an elbow 12 connecting an upper arm 14 and a lower arm or forearm 16, it will be appreciated that the principles of the present invention apply to any major joint, with the orthotic coupling means being configured and dimensioned to grasp the respective body portions on opposite sides of the major joint.

The orthosis 10 comprises a pair of orthotic coupling means or shells generally designated 20, including a first or proximal coupling means 22 for grasping a first or proximal body portion (such as the upper arm 14) adjacent the major joint (such as the elbow 12) for movement therewith, and a second or distal coupling means 24 for grasping a second or distal body portion (such as the forearm or lower arm 16) adjacent the major joint for movement therewith. Each coupling means 20 preferably comprises a pair of orthotic half-shells 26 hingedly secured together by at least one appropriate hinge means 28.

The hinge means 28 may either be flexible (such as tape or even a living hinge) or composed of rigid elements (such as a mechanical hinge of aluminum having two portions adapted for relative movement about a hinge pin). Hinge means 28 enables the two half-shells 26 to be moved between an open orientation permitting insertion of a limb portion therein or removal of a limb portion therefrom, and a closed orientation which precludes removal of a limb portion therefrom. If desired, a plurality of hinge means 28 may be longitudinally spaced along each coupling means 22, 24.

Figure 3:
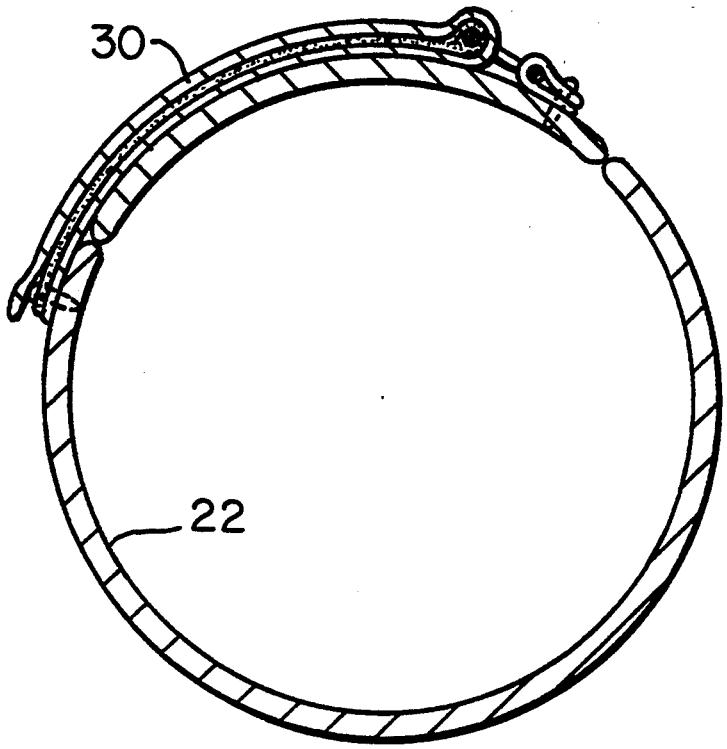
FIG. 3 is a sectional view taken along the line 3—3 of FIG. 2.
Figure 4:
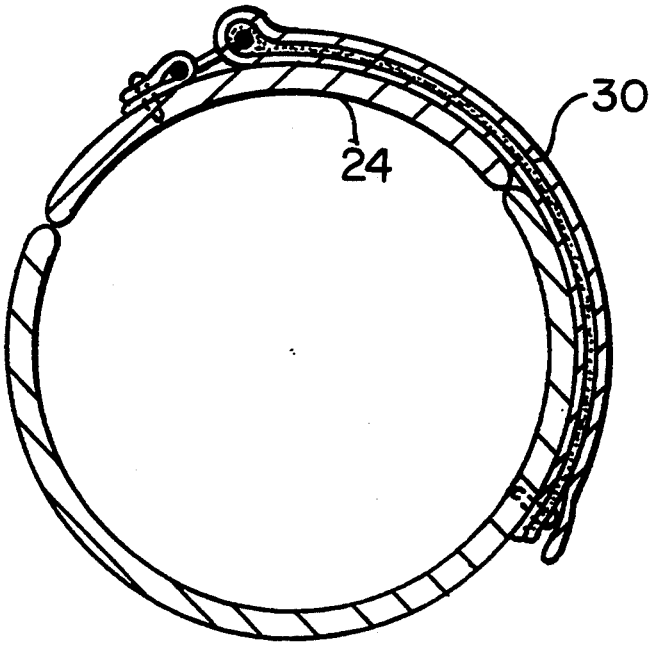
FIG. 4 is a sectional view taken along the line 4—4 of FIG. 2.
Figure 5:
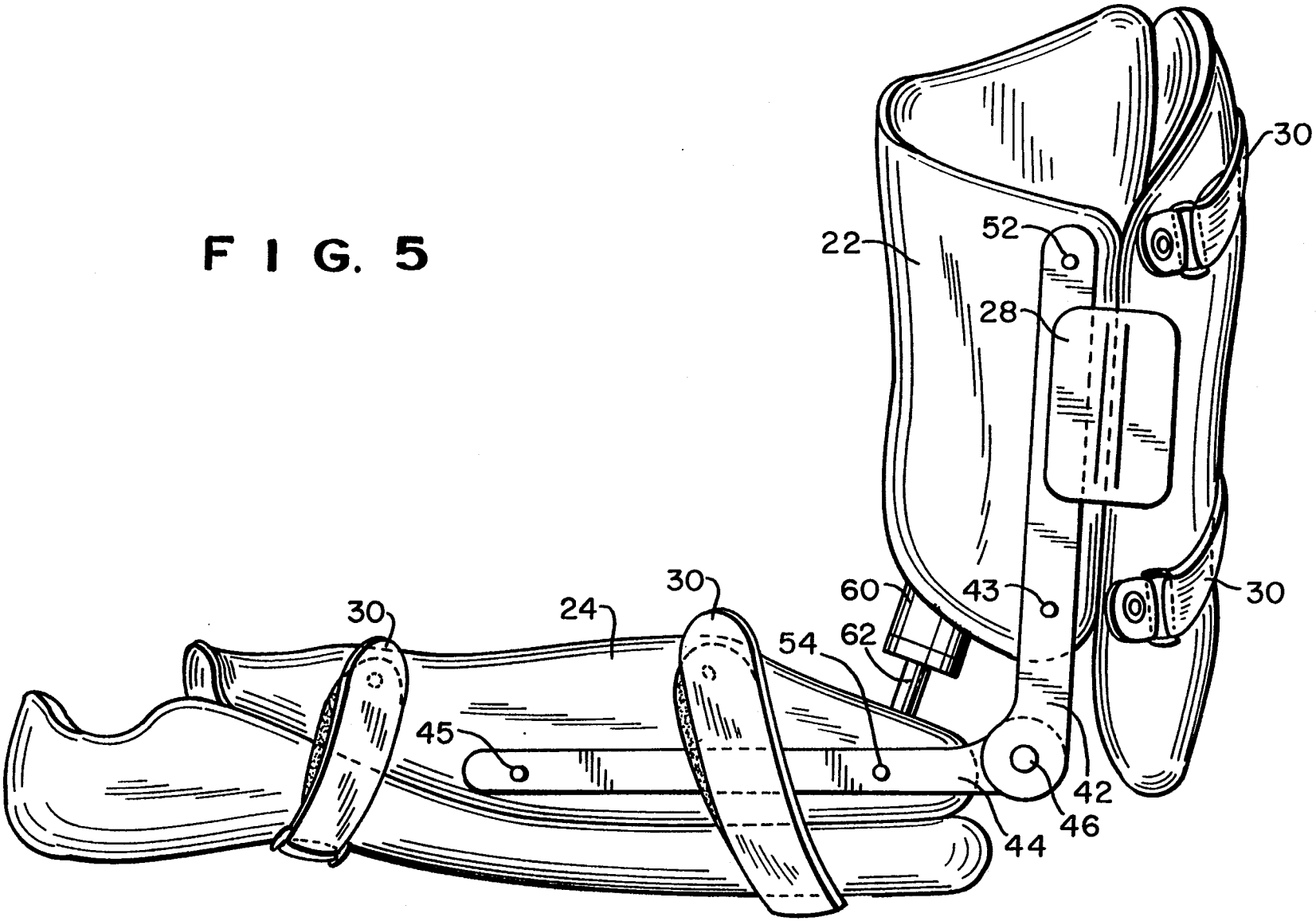
FIG. 5 is a side elevational view taken from the side opposite that shown in FIG. 2.
Figure 6:
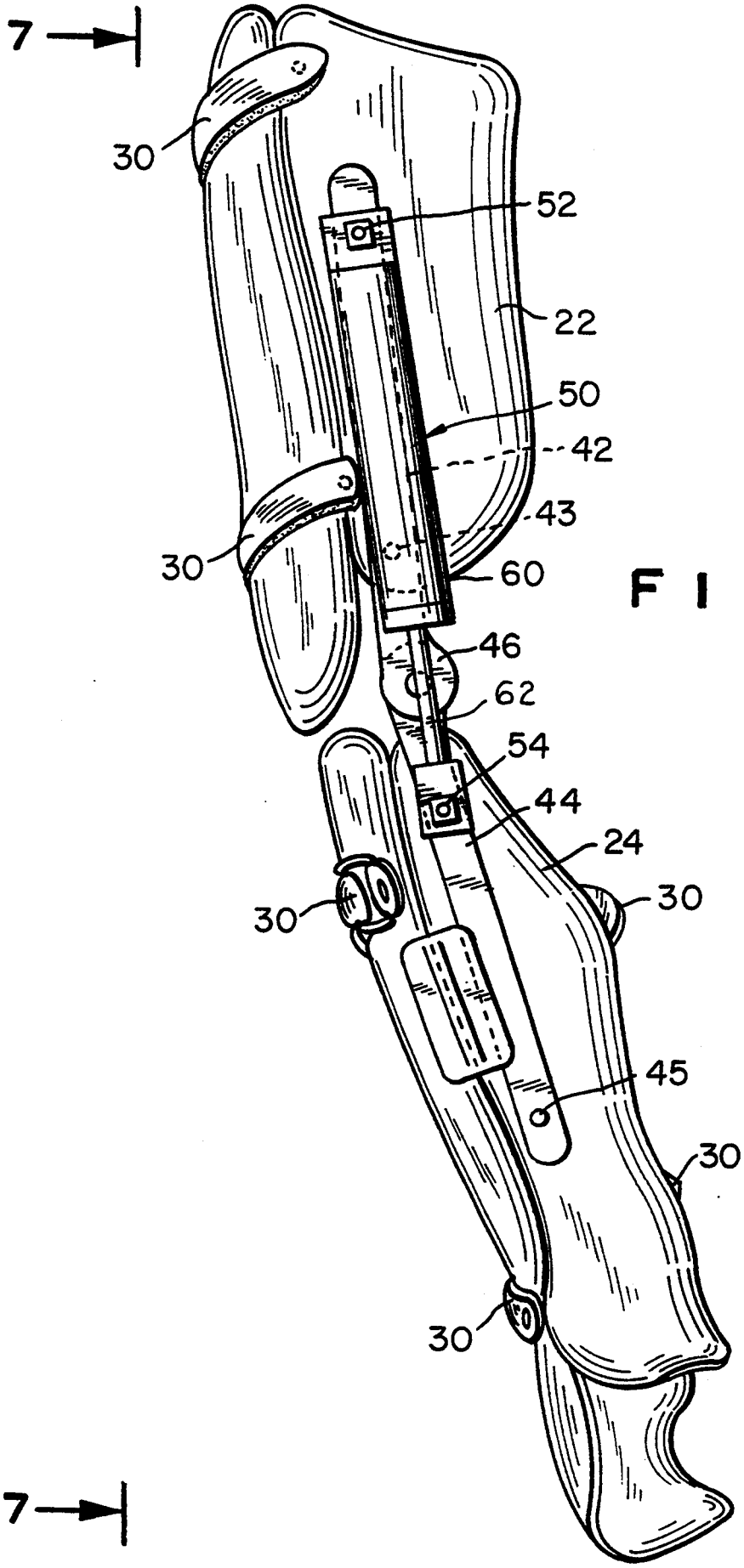
FIG. 6 is a side elevational view thereof in a fully extended configuration.
Figure 7:
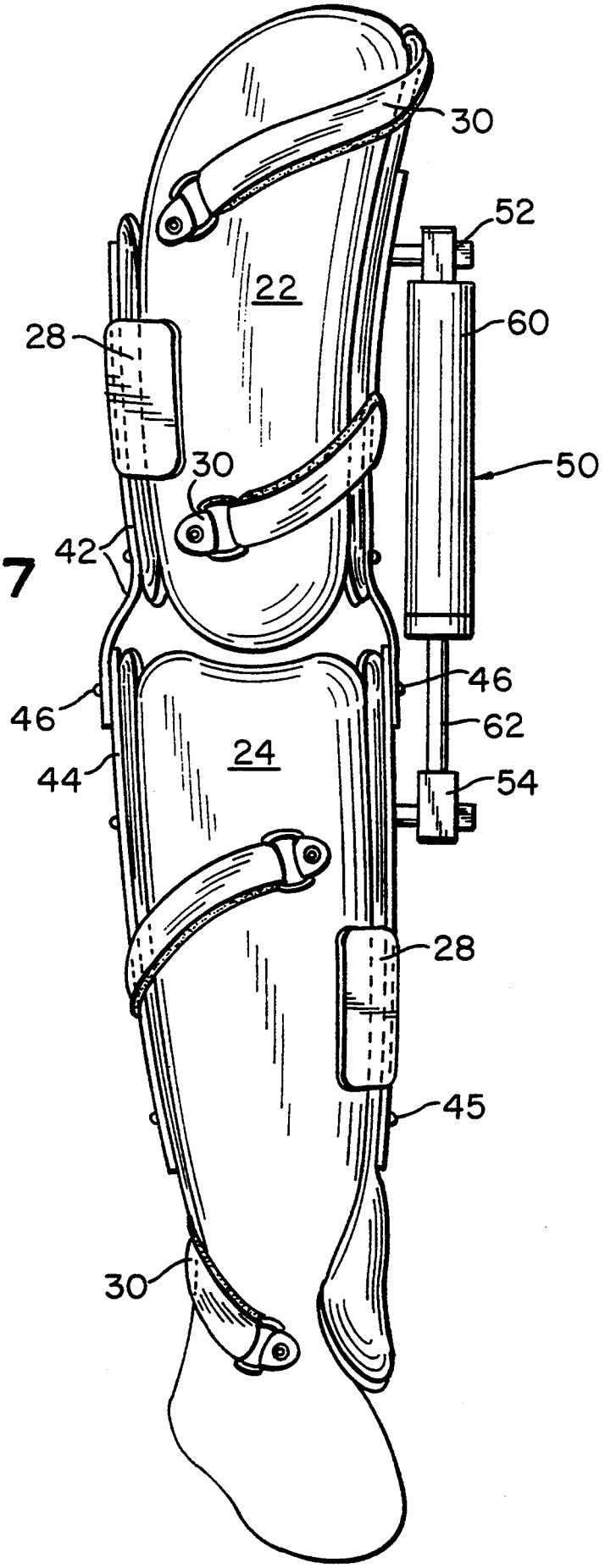
FIG. 7 is an elevational view taken along the line 7—7 of FIG. 6.

In order to maintain the two half-shells 28 in the closed orientation once they have been placed about a limb portion, at least one releasable fastening means 30 is used, whether flexible (such as fabric tabs permanently secured to one half-shell and adapted to releasably engage complementary material permanently secured to the other half-shell (a VELCRO closure), or a flexible tab which is permanently secured to one half-shell and releasably connectable to the other half-shell by snap fasteners or the like) or composed of rigid elements (such as a metal or plastic tab permanently secured to one half-shell and releasably secured to the other half-shell). As illustrated, each of the two fastening means 30 on each coupling means 20 comprises a flexible strap of strong textile material which is secured at one end to one half shell 26 and threaded through a loop secured on the other half shell 26, and then passed back on itself (as best seen in FIGS. 3 and 4). One of the facing surfaces of the doubled over strap defines a large plurality of microhooks and the other facing surface of the strap defines a large plurality of microloops, with the microhooks and microloops forming a closure or fastening system known under the trade name VELCRO. It will be appreciated that a variety of different hinge means 28 and fastening means 30 may be employed.

The particular applications of the orthotic coupling means 20 may desirably have three one-third shell means (or even more partial shell means) so long as they are movable between a first orientation permitting entry thereinto of a body portion and a second orientation precluding removal of the body portion therefrom. Indeed, in certain instances, such as when the major joint is an elbow, the orthotic coupling means 20 may simply be slipped over the hand and onto the appropriate limb portions without the use of any hinge means 28 or fastening means 30, the coupling means 20 being retained in place by interaction between at least one of the coupling means and a portion of the wearer's body (such as the palm or elbow).

In the case of an elbow orthosis, the proximal or upper arm (humeral) coupling means 22 encompasses the olecranon process of the elbow 12, while the distal or lower arm (forearm) coupling means 24 encompasses the wrist 32, extending into the hand 34 into the palmar crease, but allowing for free thumb and digit movement. Preferably the wrist and hand portion of the lower arm coupling means are molded so as to provide a 45° angle of pronation. The extension of the upper coupling means 20 over the olecranon process at the rear of the elbow (but not the front thereof) assists in maintaining the orthosis properly positioned on the arm and provides a convenient resting place for the arm and orthosis which provides support therefor. However, it will be appreciated that the upper coupling means 22 may be devoid of any extension which goes over the major joint 12 and, in the case of other major joints, it may be desirable to have a shorter upper coupling means 22 which does not extend over the major joint.

Connecting means generally designated 40 are provided on each side of the orthosis 10 for connecting adjacent end portions of the pair of coupling means 20 (preferably the lower end portion of the first coupling means 22 and the adjacent upper end portion of the second coupling means 24) and permitting such first and second coupling means 22, 24 to pivot freely relative to one another about the pivotal axis of the major joint 12. The connecting means 40 may limit movement of either limb portion out of the common plane defined by the major joint 12 and two limb portions 14, 16, but does not appreciably limit the free pivotal movement of the coupling means 22, 24 relative to one another about the pivotal axis of the major joint 12 (within the common plane of the major joint 12 and the limb portions 14, 16).

In the preferred embodiment illustrated, each of the two connecting means 40 includes a rigid upper leg 42 fixedly secured at two points 43, 52 to and extending parallel to the longitudinal axis of the first coupling means 22, a rigid lower leg 44 fixedly secured at two points 45, 54 to and extending parallel to the longitudinal axis of the second coupling means 24, and a pivot mechanism 46 pivotably connecting the upper and lower legs 42, 44 of the connecting means 40 for free relative pivotal movement thereof. The legs 42, 44 of the connecting means 40 may be formed separately from or as part of the orthotic coupling means 22, 24, respectively. While it is appreciated that in the real world any pivot mechanism introduces an element of friction between movement of the legs thereof, the frictional forces restraining the free pivotal movement of the legs 42, 44 about the pivot axis are minor and insignificant relative to the other forces at play, described hereinafter, and hence the pivot mechanism 46 will be considered herein as allowing the legs 42, 44 free relative pivotal movement thereabout. The legs 42, 44 may be adjustable in length in order to ensure that the pivot axis defined by the pivot mechanism 46 is coincident with the pivotal axis of the major joint 12.

The half-shells 26 of the coupling means 20 are preferably custom molded to the patient's anatomical contours from a lightweight, rigid plastic such as a polypropylene laminate. The legs 42, 44 of the connecting means 40 are preferably formed of a lightweight, rigid metal such as stainless steel, although other materials may also be employed for this purpose. Both the half-shells 22, 24 and the legs 42, 44 may be provided with padding (not shown) on the inner surfaces thereof for the comfort of the wearer.

A resistance means generally designated 50 operatively connects the first and second coupling means 22, 24 for creating a bidirectional velocity-proportional resistance in both tension and compression modes to relative pivotal movement of the first and second coupling means 22, 24 about the axis of the pivot mechanism 46 (coincident with the pivot axis of the major joint 12). The resistance means 50 is preferably disposed between and operatively secured at each end thereof to a respective coupling means 22, 24 by means of a pivot 52, 54, respectively. Preferably the same pivots 52, 54 also act as fixing points for the legs 42, 44 of the connecting means 40.

More particularly, the resistance means 50 is a bidirectional cylinder-piston shock absorber or damper, including a cylinder 60 and a piston 62. Suitable shock absorbers of this type include the double-acting linear hydraulic dampers available from Taylor Devices Inc. of North Tonawanda, N.Y. under the trade name FLUIDSHOKS. While the illustrated resistance means 50 is hydraulic in nature, clearly, pneumatic and other types of damping devices may be used alternatively. The resistance means 50 is preferably disposed between the first and second coupling means 22, 24 at an intersecting angle to the longitudinal axes of the coupling means 22, 24 and is immediately connected only to such coupling means 22, 24 (that is, it is not connected directly to the connecting means 40). Each end of the resistance means 50 may be secured to its respective half-shell 22, 24 at any point along the length thereof, but the damping action of the resistance means 50 is enhanced as a result of leverage the closer the resistance means ends are to the free ends of the coupling means 20 (that is, the ends of coupling means 20 remote from the connecting means 40). It will be appreciated, that, in addition to the pivot mechanism 46 of each connecting means 40, there are only the two pivot mechanisms 52, 54 (one securing each respective end of the resistance means 50 to a respective coupling means 22, 24) so that there are only a total of four pivot mechanisms between the coupling means 20 (excluding, of course, the hinge means 28 of each coupling means 20).

As illustrated, the resistance means 50 and the connecting means 40 are essentially separate and distinct elements although the pivots 52, 54 are illustrated as also acting as securing points for legs 42, 44 of connecting means 40. However, it will be readily appreciated by those skilled in the art that the resistance means 50 and the pivot mechanism 46 of connecting means 40 may be integrated by a suitable mechanism which provides the desired progressive proportional resistance to relative pivotal movement of the coupling means 22, 24 about the pivot mechanism 46, the resistance being transmitted to the coupling means 22, 24 from the pivot mechanism 46 via the legs 42, 44. In this instance preferably the axis of the resistance means 50 would be disposed parallel to and adjacent the pivot axis of the major joint 12.

While a "generic" orthosis according to the present invention may be made for any given major joint, preferably the coupling means or shells 20 are custom molded to ensure comfort for a particular wearer by optimally distributing force, and the resistive strength of the resistance means 50 and the nature and location of its connections to the coupling means 20 is selected to particularly accommodate a particular wearer and the particular functions of interest to him or her. Thus, weaker or stronger resistance means 50 may be employed depending upon the strength of the patient, and his or her tremors. Also, since particular functions performed by the wearer (such as eating, writing, reading and the like) may each involve different motions of a major joint, the effect of the orthosis may be varied by changing the location of the connection between the resistance means 50 and one or more of the coupling means 22, 24 along the longitudinal axis of the respective coupling means. For example, to facilitate eating, preferably both connections are disposed about midway along the longitudinal length of tile respective coupling means. On the other hand, for particular activities, preferably at least one of the connections is disposed adjacent an end of its coupling means. Since the desirability of the location of the various connection between the resistance means 50 and the coupling means 22, 24 will vary with the nature of the function or task to be performed, means may be provided for varying the same in order to meet the needs of tile particular function or task at hand.

Dysmetria is believed to be diminished by progressive proportional resistance to the agonistic muscle. The resistance means 50 of the present invention acts as an artificial antagonist muscle, providing progressive proportional resistance to the agonistic muscle. The device also decreases afferent stimulation arising from the extremity with dysmetria by making the intended motions much smoother. Accordingly, the rapid, dysmetric relative movement of the proximal and distal limb portions is damped more by the resistance means 50 than is slow, controlled relative movement thereof. Accordingly, the slow, controlled, intentional movement of the wearer prevails over the involuntary, rapid, dysmetric movements of the limb portions. In other words, the present device acts as a frequency-responsive shock absorber so that the flexion-extension interplay of the major joint is damped in favor of a steady motion of the limb portions.

To summarize, the present invention provides a dynamic orthosis which incorporates a proportional resistance across a major joint connecting proximal and distal body portions, the orthosis damping non-functional rapid dysmetric relative movements of the proximal and distal body portions more than slow controlled relative movements thereof. The orthosis includes a connected pair of orthotic coupling means and a resistance means, with the resistance means being connected to the pair of connected orthotic coupling means by at most a pair of pivotal joints, thereby providing for a simpler, more economical device than the conventional devices including a larger number of such pivot joints. Additionally, the orthosis is comfortable and convenient to wear since the only connections are to the limb portions about the major joint, without requiring connection to any relatively fixed or rigid structure (such as a chair back or the patient's back). Finally, the orthosis is simple and economical to manufacture, use and maintain.

Now that the preferred embodiments of the present invention have been shown and described in detail, various modifications and improvements thereon will become readily apparent to those skilled in the art. Accordingly, the spirit and scope of the present invention are to be construed broadly and limited only by the appended claims, and not by the foregoing specification.

We claim:

1. A method of treating a patient suffering from dysmetria by dampening rapid dysmetric relative movement between proximal and distal body portions across a major point of the patient, comprising the steps of:

(A) providing a dynamic orthosis incorporating proportional resistance across a major point connecting proximal and distal body portions of the patient suffering from dysmetria, comprising:

(i) a pair of orthotic coupling means, including a first coupling means for grasping a body portion proximal to the major joint for movement therewith and a second coupling means for grasping a body portion distal to the major joint for movement therewith;

(ii) connecting means operatively connecting the first and second coupling means and permitting the first and second coupling means to pivot freely relative to one another about the pivotal axis of the major joint; and (iii) resistance means operatively connecting the first and second coupling means for creating a bidirectional velocity proportional resistance in both tension and compression modes to relative pivotal movement of the first and second coupling means;

(B) grasping the proximal and distal body portions of the patient with the first and second coupling means, respectively; and (C) attempting slow intentional movement involving the joint;

whereby rapid dysmetric relative movement of the proximal and distal body portions is dampened by the orthosis and the attempted slow intentional movement emerges.

2. The method of claim 1 wherein the proximal and distal body portions are proximal and distal limb portions.

3. The method of claim 2 wherein the major joint is an elbow and the proximal and distal limb portions are the upper arm and forearm, respectively.

4. The method of claim 1 wherein the resistance means is operatively connected to one end thereof to the first coupling means and at the opposite end thereof to the second coupling means.

5. The method of claim 4 wherein the resistance means is operatively connected only to the first and second coupling means.

6. The method of claim 4 wherein the resistance means is pivotably operatively connected at each end thereof to a respective coupling means.

7. The method of claim 1 including only four pivotable joints intermediate the first and second coupling means.

8. The method of claim 1 wherein the resistance means is a bidirectional cylinder-piston shock absorber.

9. The method of claim 1 wherein the resistance means is disposed between the first and second coupling means at an angle to the longitudinal axes of the coupling means.

10. The method of claim 1 wherein the connecting means includes a rigid upper leg fixedly secured to and extending parallel to the longitudinal axis of the first coupling means, a rigid lower leg fixedly secured to and extending parallel to the longitudinal axis of the second coupling means, and a pivot mechanism pivotably connecting the upper and lower legs for pivotal relative movement thereof.

11. The method of claim 1 wherein the resistance means dampens rapid dysmetric relative movement of the proximal and distal body portions more than slow controlled relative movement thereof.

12. A method of treating dysmetria by dampening rapid dysmetric relative movement between proximal and distal body portions across a major joint of a patient suffering dysmetria while permitting slow intentional movement therebetween, comprising the steps of:

(A) providing a dynamic orthosis incorporating proportional resistance across a major joint connecting proximal and distal limb portions of a patient suffering from dysmetria, comprising:

(i) a pair of orthotic coupling means, including a first coupling means for grasping a limb portion proximal to a major joint for movement therewith and a second coupling means for grasping a limb portion distal to the major joint for movement therewith;

(ii) connecting means operatively connecting the first and second coupling means and permitting the first and second coupling means to pivot freely relative to one another about the pivotal axis of the major joint, the connecting means including a rigid upper leg fixedly secured to an extending parallel to the longitudinal axis of the first coupling means, a rigid lower leg fixedly secured to and extending parallel to the longitudinal axis of the second coupling means, and a pivot mechanism pivotably connecting the upper and lower legs for relative pivotal movement thereof; and (iii) resistance means disposed between and operatively connecting the first and second coupling means for creating a bidirectional velocity proportional resistance in both tension and compression modes to relative pivotal movement of the first and second coupling means, the resistance means being pivotably operatively connected at one end thereof only to the first coupling means by a pivotably joint and at the opposite end thereof only to the second coupling means by a pivotable joint, the resistance means being disposed between the first and second coupling means at an angle to the longitudinal axes of the coupling means;

(B) grasping the proximal and distal body portions of the patient with the first and second coupling means respectively; and (C) the patient attempting slow intentional movements involving the joint;

whereby rapid dysmetric relative movement of the proximal and distal limb portions is dampened more by the resistance means than slow controlled relative movement thereof.

13. The method of claim 12 wherein the major joint is an elbow and the proximal and distal limb portions are the upper arm and forearm, respectively.

* * * * *